United States Patent [19]

Sorenson

[11] 3,950,808

[45] Apr. 20, 1976

[54] BUOYANCY CIRCULAR WATER SKI

[76] Inventor: Hugh E. Sorenson, 7005 W. Southridge Drive, Greenfield, Wis. 53220

[22] Filed: May 3, 1974

[21] Appl. No.: 466,538

[52] U.S. Cl. ..... 9/310 G; 9/1 A

[51] Int. Cl.[2] ..... A63C 15/00

[58] Field of Search ..... 9/310 A, 310 B, 310 C, 9/310 D, 310 E, 310 G, 6, 1 A; 272/1 B, 32, 33 A; 280/12 A, 12 B, 18, 19; 114/62, 67 A

[56] References Cited

UNITED STATES PATENTS

| | | | |
|---|---|---|---|
| 2,058,383 | 10/1936 | Maynes | 9/1 A |
| 2,389,729 | 11/1945 | Howland | 9/310 E |
| 3,126,856 | 3/1964 | Fuller | 9/6 |
| 3,383,720 | 5/1968 | Greig et al. | 9/6 |
| 3,471,876 | 10/1969 | Horiuchi et al. | 9/6 P |
| 3,716,880 | 2/1973 | Sorenson | 9/310 G |

FOREIGN PATENTS OR APPLICATIONS

| | | | |
|---|---|---|---|
| 14,172 | 7/1903 | Austria | 9/310 D |

*Primary Examiner*—Trygve M. Blix
*Assistant Examiner*—Jesus D. Sotelo
*Attorney, Agent, or Firm*—Alter and Weiss

[57] ABSTRACT

A circular water ski device an upper and lower surface and having a revolving platform on the upper surface. There is a space between the upper and lower surface filled with buoyant material. The lower surface in a first embodiment has a general concave cross-section which may capture an air bubble, and provide a relief for the escape of entrapped water in another embodiment.

5 Claims, 6 Drawing Figures

BUOYANCY CIRCULAR WATER SKI

My invention relates to an improvement in circular water skis, or the like, and more particularly to buoyant water skis.

Reference is made to my U.S. Pat. No. 3,716,880, entitled "Circular Water Skis or Surfboard", for more information about certain aspects of my present invention.

An object of my invention is to provide a circular water ski device, of the character described, which incorporates a means of providing buoyancy to the water ski, or the like, and of improving its performance and manipulation. Additionally an object is to provide new and novel bottom hull characteristics.

Another object of my invention is to enable the buoyancy of the water ski to be provided through a use of readily available, low cost material such as polyethylene, styrofoam, air, or the like.

In the performance and use of a non-buoyant water ski, it sometimes becomes difficult for the user to keep the ski disc on the surface of the water. This adds to the skill level required and reduces pleasure for the novice. By adding buoyancy, the user improves the efficiency of his performance. Also the conventional dish-shaped hull tends to merely drag through the water without modification of any laminar flow as a function of speed. Therefore, the present invention provides novel hull bottom configurations which change the laminar flow as the speed changes.

The device illustrated and described, is simple in design and efficient in its performance.

Figure 1:
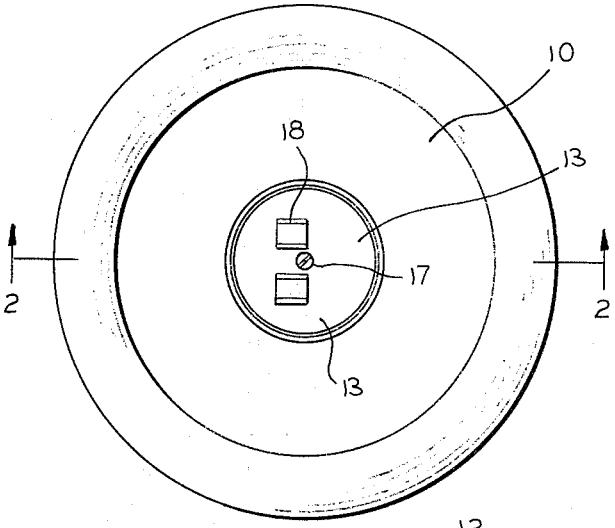
FIG. 1 is a top or plan view of the first embodiment of the inventive buoyant water ski device.
Figure 2:
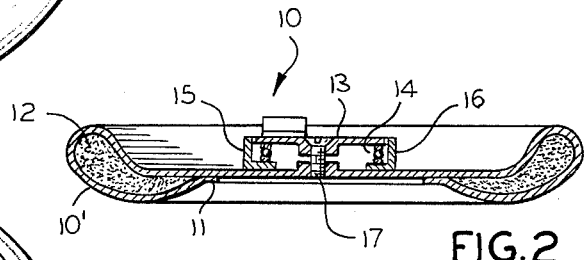
FIG. 2 is a vertical cross-sectional view of the device shown in FIG. 1, taken at the line 2—2 and looking in the direction of the arrows thereof.

In FIGS. 1 and 2, the reference character 10 identifies a circular water ski disc, which is folded downward and radially returned at 10'. The returning edge is attached at its lower edge at 11, to the bottom of the upper surface of the ski, constructed of any type of rigid material such as metal, or plastic. The folded portion 10' encloses a suitable sponge-like material 12, such as polyethylene, or the like to provide entrapped air products which gives buoyancy to the ski, to keep afloat on the top surface of the water on which it is placed. Thus, even a novice is able to keep the ski afloat.

There is centrally disposed revolvable disc 13, supported on a race of roller bearings, shown as 14. The race is mounted on a circular collar projecting upwardly at an angle 15, 16, to guide the revolvable disc 13. The center of the disc is held in position by a screw or bolt 17, threadedly engaging the main water ski disc 10 at the center.

The inner revolvable disc 13 has two stirrups 18 on its upper surface. These stirrups may be of a conventional design and are attached to the disc 13 in any convenient manner. They are used to hold the feet, to support the person, and to retain the skis during the operation.

The concave shape of the ski bottom (FIG. 2) has a smooth and unbroken shape that will tend to retain a bubble of air which helps reduce drag at low speeds. As speed increases, the user tends to rock back and lift the ski; whereupon the rear edge surface of the ski tends to be the main point of contact with the water surface. As this occurs, the rear most point on the bottom of the fold back portion 10' acts as a bow.

One difficulty with this concave configuration is that at mid-speeds there tends to be a somewhat entrapped amount of water at the center of the disc. This adds to the drag. Therefore, the embodiment of FIGS. 3 and 4 provides a plurality of dome shaped segments around the periphery of the concave surface, which domes define passages that relieve the entrapped area and improve the laminar flow of water.

Figure 4:
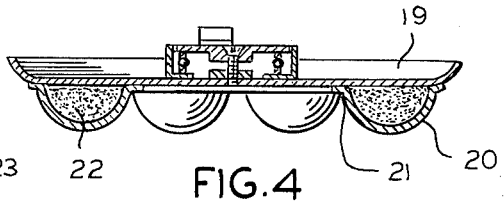
FIG. 4 is a vertical cross-sectional view of the device illustrated in FIG. 3, taken at the line 4—4 and looking in the direction of the arrows thereof.

The choice between the concave configuration of FIG. 2 and the discreet domes of FIG. 4 depends primarily upon the anticipated speed of operation.

Figure 3:
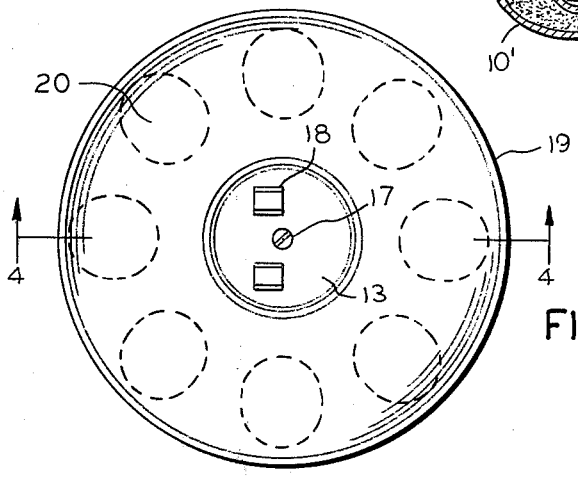
FIG. 3 is a top or plan view of another embodiment of the water ski device.

The embodiment of FIGS. 3 and 4 show a modified ski construction, in which the main water ski disc 19 is provided with a plurality of pockets 20, semi-oval or dome contour, and is attached to the lower surface of the main disc 19, as at 21. Each dome encloses and supports individual portions of sponge-type plastic, as shown at 22 in FIG. 4.

Figure 5:
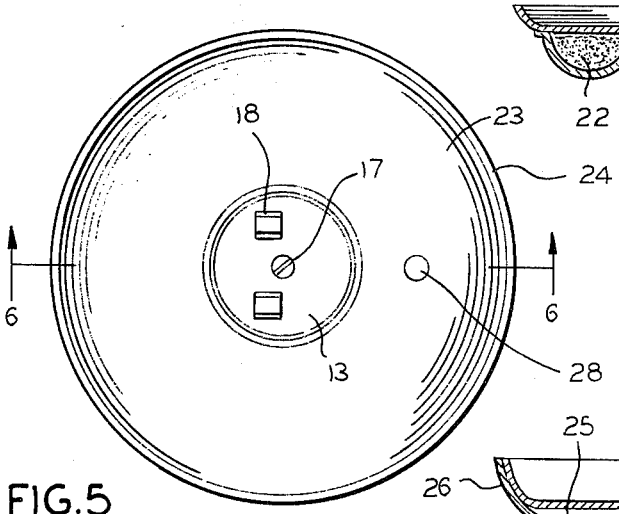
FIG. 5 is a top or plan view of yet another embodiment of the circular ski device.
Figure 6:
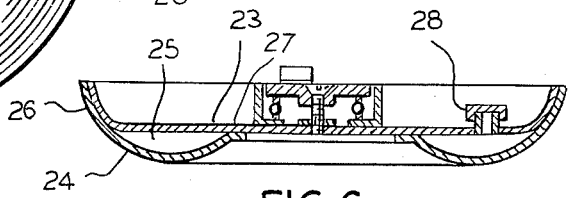
FIG. 6 is a vertical cross-sectional view of the device shown in FIG. 5, taken at the line 6—6 and looking in the direction of the arrows thereof.

Another version of the water ski that may be employed in either the concave or dome configuration (herein shown as concave) is illustrated in FIGS. 5 and 6. Here the main disc 23 has attached thereto a lower disc 24, radially indented, as shown at 25. The lower disc is attached to the main disc 23 at both its outer edge 26 and its inner edge at 27. The indented lower disc 24 acts as an air chamber and provides buoyancy to keep the water ski 23 afloat on the surface of the water. A conventional air valve 28 may be used, if desired, to insert compressed air. Or at a very low cost, novelty version, the entire unit may be a collapsible unit which is inflated prior to use. Many changes may be made without affecting the performance of the device as described and illustrated. Therefore, the appended claims are to be construed to cover all equivalent structures.

I claim:

1. A circular water ski comprising an upper surface and a lower surface, a centrally located revolving platform on the upper surface with stirrups thereon, and space between said upper and lower surfaces filled with buoyant means, the lower surface having a generally concave surface presented to the surface of the water, said surface having a periphery which is smooth and unbroken to capture an air bubble when parallel to the surface, and rounded in cross-section to form a bow when the ski is tipped back on an edge.

2. The ski of claim 1 wherein said space is filled with plastic foam.

3. The ski of claim 1 wherein said space is filled with air.

4. The ski of claim 1 wherein said ski is made from a single plastic part folded back on itself to form said space.

5. The ski of claim 1 wherein said ski is made from a single sheet of plastic folded back on itself to form said space with the circumferential periphery of the lower hull's concave surface being smooth and unbroken, to capture an air bubble when parallel to the surface, and rounded in cross-section to form a bow when the ski is tipped back on an edge, said space being filled with plastic foam.

* * * * *